US007051465B2

(12) United States Patent
Slesinski et al.

(10) Patent No.: US 7,051,465 B2
(45) Date of Patent: May 30, 2006

(54) TRAILER DOOR ADVERTISING SYSTEM

(76) Inventors: Steven G. Slesinski, 5240 Saddleclub Dr., Kalamazoo, MI (US) 49009; Charles E. Reagan, 81 Moran Rd., Grosse Pointe, MI (US) 48225

( * ) Notice: Subject to any disclaimer, the term of this patent is extended or adjusted under 35 U.S.C. 154(b) by 0 days.

(21) Appl. No.: 10/647,037

(22) Filed: Aug. 23, 2003

(65) Prior Publication Data

US 2005/0039362 A1 Feb. 24, 2005

(51) Int. Cl.
*G09F 21/04* (2006.01)

(52) U.S. Cl. ..... 40/590

(58) Field of Classification Search ..... 40/590, 40/591, 606.01, 607.13; 116/28 R; D12/106, D12/400

See application file for complete search history.

(56) References Cited

U.S. PATENT DOCUMENTS

| | | | | |
|---|---|---|---|---|
| 1,194,879 | A * | 8/1916 | Rumbarger | 40/590 |
| 2,724,917 | A * | 11/1955 | Norfleet | 40/591 |
| 3,245,165 | A * | 4/1966 | Podoloff | 40/591 |
| 3,481,059 | A * | 12/1969 | Lowmaster | 40/643 |
| 3,802,103 | A * | 4/1974 | Neff | 40/591 |
| 4,161,834 | A * | 7/1979 | Hendricks, Jr. | 40/606.09 |
| 6,037,866 | A * | 3/2000 | Leibowitz | 40/610 |
| 6,470,612 | B1 * | 10/2002 | Pountney | 40/607.13 |

* cited by examiner

*Primary Examiner*—Gary C. Hoge
(74) *Attorney, Agent, or Firm*—Raggio & Dinnin, P.C.

(57) ABSTRACT

A sign assembly for mounting on a motor vehicle includes a first and second panel mounted to left and right rear doors, respectively, of a cargo storage compartment in a motor vehicle. The panels have substantially parallel inner edges positioned adjacent when the left and right rear doors are closed, an interface of the inner edges substantially aligned with an interface of the rear doors when closed. A plurality of spacers are positioned between the panels and the rear doors, and the spacers are sized to position the panels substantially parallel with the rear doors and sufficiently spaced therefrom to provide clearance for a vertical locking bar assembly integral with at least one of the doors.

6 Claims, 1 Drawing Sheet

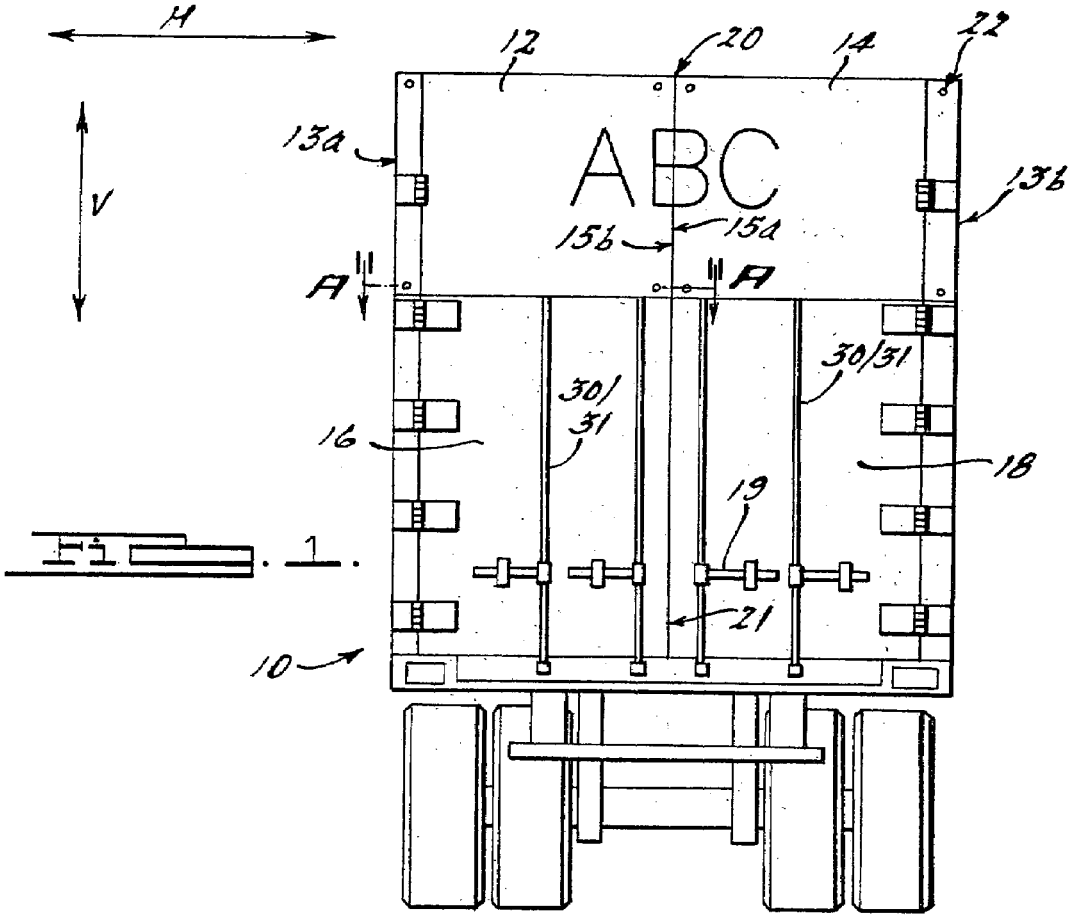
Fig. 1.
Fig. 2.
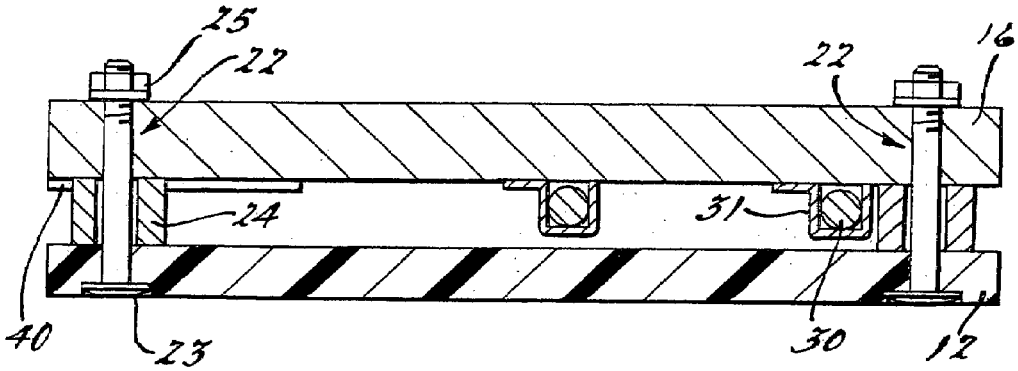

TRAILER DOOR ADVERTISING SYSTEM

TECHNICAL FIELD

The present invention relates generally to advertising and signage displays and devices, and in particular to such a device mounted on rear doors of a cargo storage area of a vehicle.

BACKGROUND OF THE INVENTION

Busses, trucks, cars and other motor vehicles have long been used for displaying advertising material. In the most familiar cases, companies owning semi trucks and other vehicles display their corporate logos and slogans or other company information on the vehicles. A less common, but increasingly prevalent example is the use of semis, busses, etc. as mobile road signs. In such applications, the vehicle owner rents space or time, for example, or charges by the mile, to entities that wish their ads to be displayed on the vehicle as it travels. The mobility of motor vehicles allows signs, insignia and other informational media to be conveyed to large, diverse audiences. The painting of signs or application of vinyl graphics on large trucks is well known and widely used, particularly for advertising the goods being transported. However, such signage is relatively permanent and is expensive to change. For trucks dedicated to a single company, painted signs are acceptable and provide a visually stimulating appearance.

A majority of cargo bearing trucks or tractor trailers are not dedicated to a single company or product. Further, many trailers are fungible, mobile storage containers and truck drivers will drop off one trailer at a distribution point and pick up a different trailer for a return trip. Trailers may be left at a distribution point for days and may be used for various goods, different drivers and travel to a number of destinations. Thus, it is impractical to attempt to predict in advance where and when a trailer will be on the road. This lowers the value of placing relatively permanent advertising on a trailer, as the exposure of such advertising is relatively ineffective.

Over the years, there have been various unique contributions to the art, including the addition of electronic signs and symbols, and the use of removable signs mounted in permanent brackets installed on the vehicle itself. One problem that has continually plagued the industry, however, has been the labor and expense involved in retrofitting vehicles with the various fastening and bracketing arrangements that render them capable of supporting the advertising assemblies mounted thereon. In particular, it has proven challenging to design mounting arrangements compatible with the various external features of the vehicle. In the case of semi trailers to which advertising assemblies are to be mounted, fasteners, hinges, external lighting and locks, etc. have heretofore provided impediments in designing suitable advertising systems for mounting on the vehicle. In particular, most trailers have a rear door locking system which includes an elongated bar which engages the top of the trailer thus preventing the prying of the top door edges but is engagable from ground level. This locking system extends several inches from the rear door surface, and complicates applying a flat sign along the rear door surfaces. The dual rear door system of most trailers also complicates the application of signage upon the rear doors. There have been efforts to divide the signage and apply half on each door to meet when the doors are closed.

SUMMARY OF THE INVENTION

The present invention provides an advertising assembly for mounting on an exterior of a motor vehicle. The assembly includes a first panel and a second panel, the first and second panels mounted on left and right rear doors, respectively, of a cargo storage area of a motor vehicle. The first and second panels have parallel inner edges that are substantially aligned when the left and right rear doors of the cargo storage area are closed. A plurality of spacers having substantially equal lengths is disposed between the panels and the doors.

BRIEF DESCRIPTION OF THE DRAWINGS

FIG. 1 is a perspective view of a motor vehicle having rear doors with a vehicle advertising system according to a preferred constructed embodiment of the present invention mounted thereon;

FIG. 2 is a sectioned view taken along line A—A of FIG. 1.

DETAILED DESCRIPTION OF PREFERRED EMBODIMENTS

Referring to FIG. 1, there is shown a perspective view of a motor vehicle, for instance, the rear of a semi-trailer, having a vehicle advertising system 10 mounted thereon, and constructed in accordance with a preferred embodiment of the present invention. Various references are made in the present disclosure to "vertical" and "horizontal" directions. For clarity, FIG. 1 includes a legend, in which the orientation of a first arrow "V" and the orientation of a second arrow "H" represent approximate vertical and horizontal directions, respectively, as used in reference to the features of the present invention herein. It should be appreciated that as used herein, the term "vehicle" contemplates vehicles such as semi trucks having detachable cargo storage areas like trailers, as well as other trucks or vans in which the cargo storage area is integral with the rest of the vehicle. Those skilled in the art will appreciate that the present invention may find application with many vehicles, and various modifications might be made to the presently disclosed embodiments without departing from the intended spirit and scope of the present invention.

Advertising system 10 comprises first and second panels 12 and 14, respectively, preferably mounted to left and right rear doors 16 and 18, respectively, of a vehicle cargo storage area. Panels 12 and 14 are preferably substantially rectangular, and are preferably attached to doors 16 and 18 at attachments 22 located at the corners of the panels. In a preferred embodiment, panels 12 and 14 serve as a backing for a sign on the rear of the vehicle. For example, a lettered sign such as "A B C", as shown in FIG. 1 may be affixed to panels 12 and 14. Panels 12 and 14 may be formed from any suitably rigid material such as metal, plywood, masonite, or any of a wide variety of other materials. Where a vehicle is operated primarily at lower speeds, for instance a truck for local deliveries, the relatively lower aerodynamic forces may allow the use of flimsier materials than on vehicles operated primarily at higher speeds, like a highway semi truck/trailer. Embodiments (not shown) are contemplated that utilize advertising media other than ordinary signs. For instance, electronic graphics displays having fixed or changing images might be mounted on or with panels 12 and 14. In a preferred embodiment, however, advertising system 10 includes painted panels, or panels having adhered plastic, paper or textile graphics attached thereto. As used herein, "graphics" should be understood to encompass any type of lettering, artwork or electronic display, and is not limited to a single advertisement. When the doors are closed, the panels are aligned in substantially the same plane, preferably imparting the appearance of a unitary (substantially seamless) graphics display.

In a preferred embodiment, panels 12 and 14 are independently attached to left and right rear doors 16 and 18, allowing the doors to be opened for accessing the cargo area of the vehicle when desired. Stated another way, each panel is attached to its associated door alone, without attachments to the door associated with the other panel. Alternative embodiments are contemplated, in which the panels are primarily attached by an attachment device 33 to the vehicle or trailer body surrounding the doors. In such an embodiment, the panels may be mounted to the body with any suitable type of hinge along their outer vertical edges 13*a* and 13*b*. Mechanical attachments, any suitable fastener, are then positioned along the inner edges 15*a* and 15*b* of the panels, and attach the panels to the rear doors. Where the panel hinges are separated by a horizontal distance from the door hinges by more than a few centimeters, it may be necessary to fasten the panels to the doors with an attachment having a certain degree of play or tolerance, to accommodate a difference in swing trajectory between the panels and the doors. This might be done, for example, by positioning a bolt securely on the door, but forming a slot in the panel, and allowing the bolt to slide therein during opening and closing of the doors.

Returning to the embodiment pictured in FIG. 1, the panels are preferably positioned such that their inner edges 15*a* and 15*b* are substantially aligned with each other when the doors are closed, defining an interface 20 that is substantially aligned with an interface 21 of doors 16 and 18. In a typical semi truck/trailer combination or other cargo vehicle, the doors for accessing the cargo area are substantially the same size, and their vertical interface 21 is located substantially in the middle of the rear of the vehicle. Because the doors are typically of substantially equal dimensions, the panels of the present invention are preferably substantially equal in width (as measured in a horizontal direction across the rear of the vehicle). As such, the panels 12 and 14 each preferably represent about one half the total width of the area available for mounting the sign or other advertising material. It should be appreciated, however, that other embodiments such as those shown in FIGS. 3 and 4 are contemplated in which a portion of one panel comprises more than one half the total area of the sign. Note the movement of interface 20 between FIG. 1 and FIG. 3. Also note the extension of panel 12 in FIG. 4. This embodiment could include a first panel having a first width, and a second panel having a second, greater width. In such a design, the wider panel would overlap a portion of the opposite door when the cargo doors are closed, and the interface of the panels would lie laterally of the interface of the doors 21.

Turning to FIG. 2, there is shown a sectioned view of a panel 12 and cargo door 16 taken approximately at line A—A of FIG. 1, illustrating two attachments 22 therewith and a hinge 40 for door 16. It should be appreciated that hinge 40 is merely illustrative, and illustrated schematically. It is contemplated that any suitable hinge might be used in conjunction with the present invention. In a preferred embodiment, attachments 22 are designed such that a clearance distance is maintained between panel 12 and door 16. This clearance accommodates a vertical sliding locking bar 30, used in many cargo vehicles to secure the rear doors. An alternative embodiment as shown, includes a panel formed having a semi-circular or alternatively shaped "cutout" region for accommodating the sliding bar 30.

In the embodiment pictured in FIG. 2, bar 30 is retained at least in part by a bracket or a sleeve 31, and slides therein, an end of the locking bar 30 received in a hole (not shown) in the floor of the trailer, or in a structure attached thereto, in a well known fashion. When it is desirable to open the cargo doors, the locking bar 30 is lifted (vertically) out of engagement with the hole, and the doors are allowed to swing outwardly. Referring in addition to FIG. 1, a cross bar apparatus 19, also of well known construction, can be engaged with bar(s) 30, and locked to prevent unauthorized lifting of the bars 30 and opening of the cargo doors 16 and 18. Each attachment 22 preferably comprises a fastener 23, which is preferably a bolt such as a conventional carriage bolt, a spacer 24, and a nut 25. Spacers 24 are preferably between about 1" and about 3", and most preferably between about 1¼" and about 2¾". Conventional washers may be added to facilitate assembly, or for additional spacing as needed. Spacer 24 can be any suitable known spacing member, however, it is preferably a conventional cylindrical metal or other material spacing member that fits around fastener 23, and is preferably sized to provide sufficient clearance between panel 12 and door 16 such that bar 30 and sleeve 31 can fit therebetween.

In yet another embodiment (not shown), the panels may be mounted in brackets to allow easy removal and attachment of substitute panels, for example, panels having alternative advertising on them, or replacements for damaged or worn panels. In such an embodiment, the panels can be slid or clamped into a three-sided retaining bracket, much like a piece of glass is slid into and retained in a picture frame. Thus, the embodiment would utilize brackets having grooves for sliding receipt of the rigid, substantially rectangular panels. Once inserted, a fourth side to the retaining bracket can be attached, or some other fastening system used. Still other contemplated embodiments could utilize yet other types of frames for retaining the panels. In one such embodiment (also not shown), the panels can be positioned and secured with frames mounted at the four corners of the panels. Fasteners such as bolts or screws are then used to attach the panels to the frames. Panels or frames can also be attached to existing door hinges and fastened with spacers and previously mentioned attaching system near door edge.

The present description is for illustrative purposes only, and should not be construed to limit the scope of the present invention. Other aspects, features and advantages will be apparent upon examination of the attached drawing figures and appended claims.

What is claimed is:

1. An advertising assembly for mounting on an exterior of a motor vehicle comprising:

a first panel and a second panel, said first and second panels mounted on left and right rear doors, respectively, of a cargo storage area of a motor vehicle, said first and said second panels having parallel inner edges substantially aligned when the left and right rear doors of the cargo storage area are closed;

a plurality of spacers having substantially equal lengths disposed between said panels and said doors;

wherein said first and second panels have widths substantially equal to widths of the left and right rear doors, respectively; an interface of the inner edges substantially aligned with an interface of the left and right rear doors when closed and the panels aligned in the same plane.

2. The sign assembly of claim 1 wherein said cargo storage area is a semi trailer.

3. The sign assembly of claim 1 wherein said cargo storage area is a cargo compartment integral with a motor vehicle.

4. An advertising assembly for mounting on an exterior of a motor vehicle comprising:

a first panel and a second panel, said first and second panels mounted on left and right rear doors, respectively, of a cargo storage area of a motor vehicle, said first and said second panels having parallel inner edges substantially aligned when the left and right rear doors of the cargo storage area are closed;

a plurality of spacers having substantially equal lengths disposed between said panels and said doors;

wherein said first panel and said second panel have different horizontal widths, one of said first and second panels overlapping a portion of the opposite door when the doors are closed.

5. The sign assembly of claim 4 wherein said cargo storage area is a semi trailer.

6. The sign assembly of claim 4 wherein said cargo storage area is a cargo compartment integral with a motor vehicle.

* * * * *

UNITED STATES PATENT AND TRADEMARK OFFICE

CERTIFICATE OF CORRECTION

PATENT NO. : 7,051,465 B2
APPLICATION NO. : 10/647037
DATED : May 30, 2006
INVENTOR(S) : Steven G. Sleinski et al.

It is certified that error appears in the above-identified patent and that said Letters Patent is hereby corrected as shown below:

Missing Figures 3 and 4

Col. 4, Line 1 - Please delete "as shown" and insert -- "(not shown)" -- after alternative embodiment.

Signed and Sealed this

Seventeenth Day of October, 2006

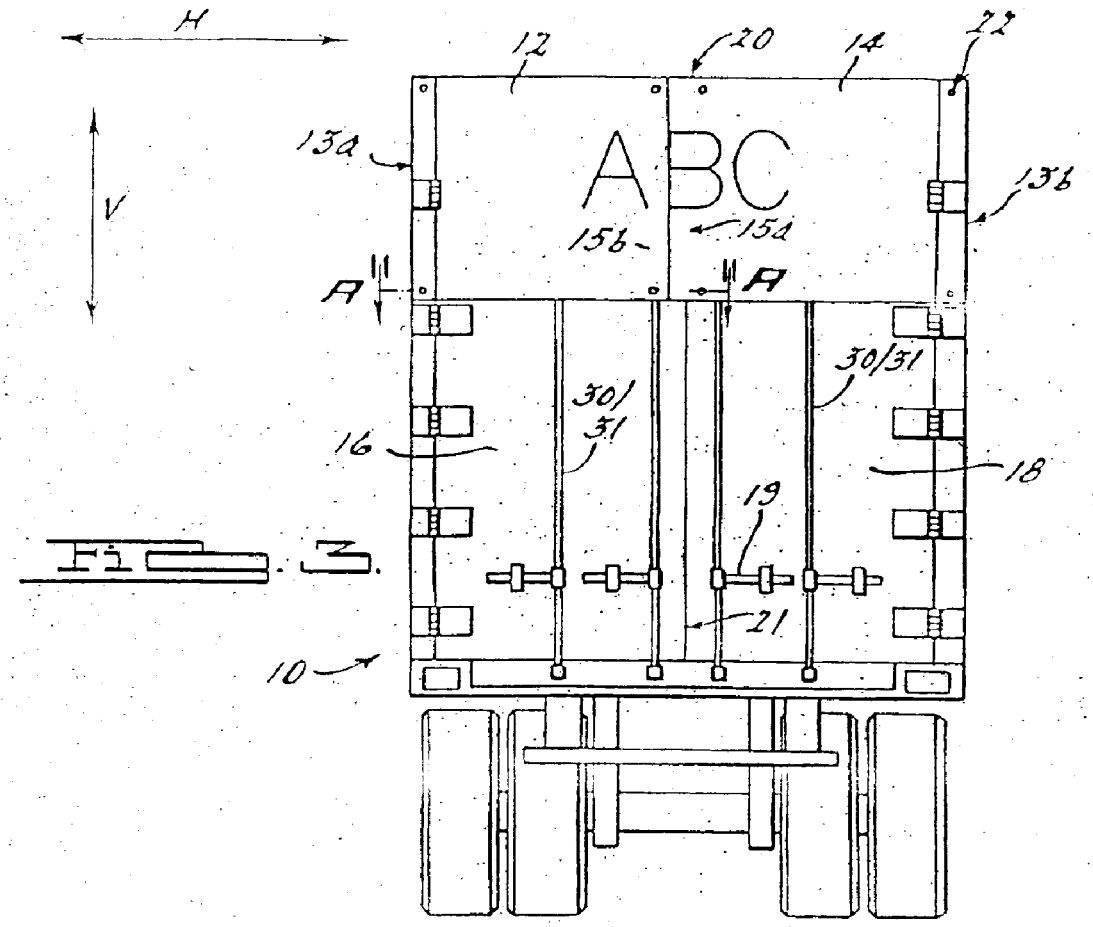
FIG. 3.
FIG. 4.
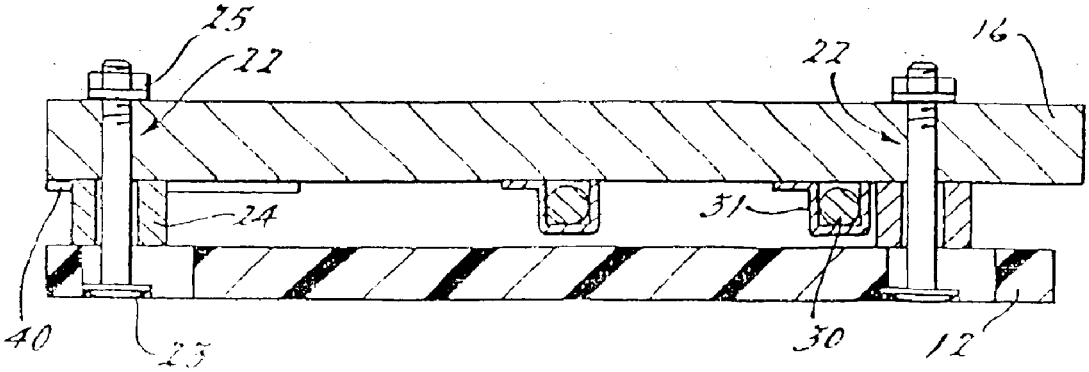

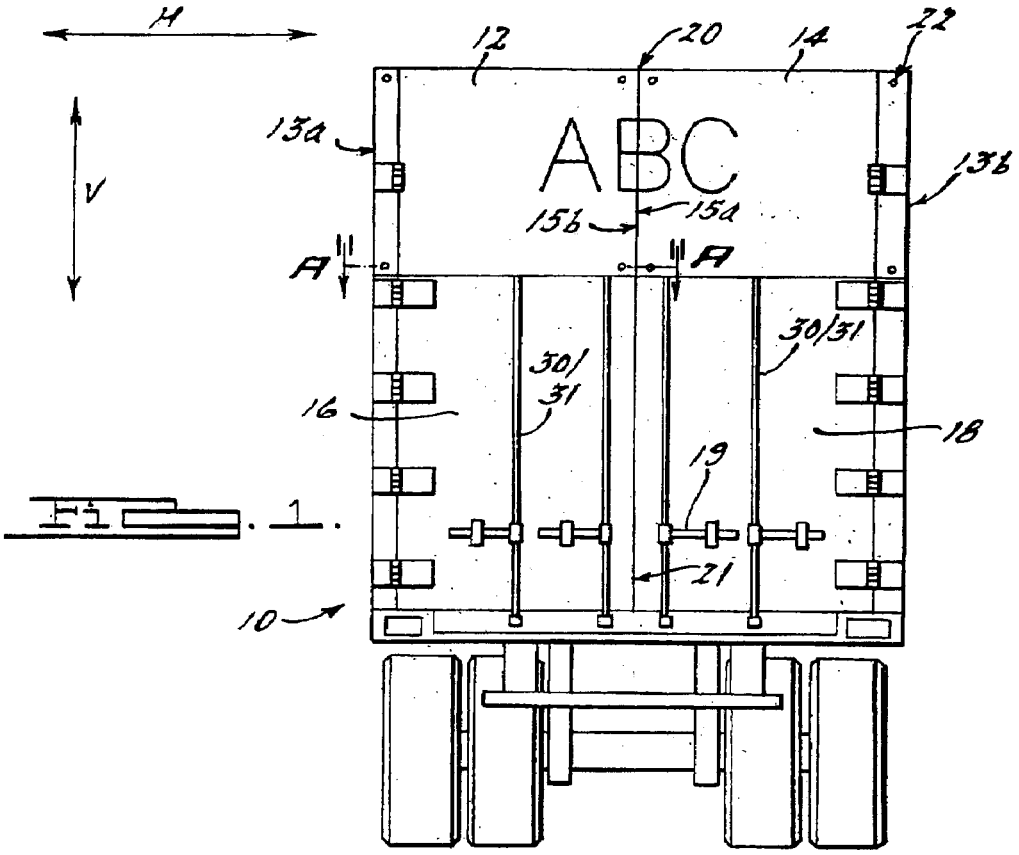
FIG. 1.
FIG. 2.
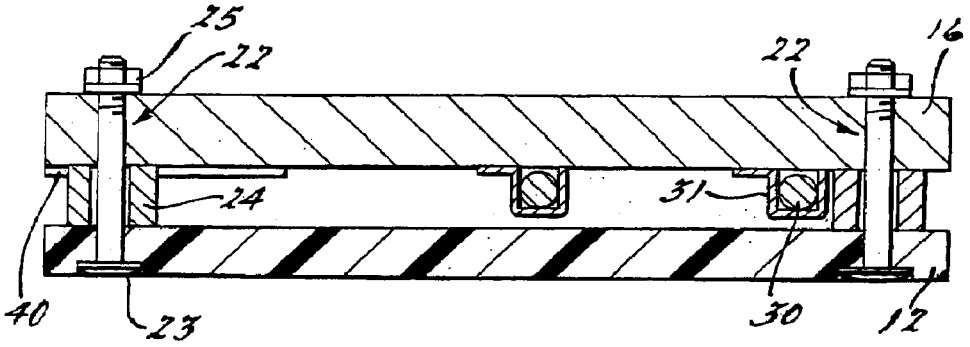

JON W. DUDAS
*Director of the United States Patent and Trademark Office*